US007293522B1

(12) United States Patent
Elson

(10) Patent No.: US 7,293,522 B1
(45) Date of Patent: Nov. 13, 2007

(54) ROLLER ASSEMBLY FOR FLOATING DOCK

(75) Inventor: Todd A. Elson, Claremore, OK (US)

(73) Assignee: HydroHoist International, Inc., Claremore, OK (US)

( * ) Notice: Subject to any disclaimer, the term of this patent is extended or adjusted under 35 U.S.C. 154(b) by 459 days.

(21) Appl. No.: 10/697,472

(22) Filed: Oct. 29, 2003

(51) Int. Cl.
*B63B 35/44* (2006.01)

(52) U.S. Cl. ..... 114/263

(58) Field of Classification Search ..... 114/266, 114/267, 263, 44–48; 403/1–7; 405/1–7
See application file for complete search history.

(56) References Cited

U.S. PATENT DOCUMENTS 3,058,756 A * 10/1962 Holsclaw ..... 280/414.1
3,659,546 A * 5/1972 Miklos ..... 114/246
5,251,028 A * 10/1993 Iu ..... 348/400.1
5,251,560 A * 10/1993 Ban et al. ..... 114/266
5,281,055 A 1/1994 Neitzke et al.
5,697,313 A * 12/1997 Horn et al. ..... 114/77 R
D398,576 S 9/1998 Hillman et al.
5,855,180 A * 1/1999 Masters ..... 114/263
5,875,727 A 3/1999 Elson et al.
6,006,687 A * 12/1999 Hillman et al. ..... 114/46
6,092,961 A * 7/2000 Kilgore ..... 405/7

* cited by examiner

*Primary Examiner*—Ed Swinehart
(74) *Attorney, Agent, or Firm*—Frank J. Catalano

(57) ABSTRACT

A roller assembly facilitates travel of a watercraft hull on a floating dock having a longitudinal, keel-receiving valley with a pair of flanking ridges supporting opposite sides of the hull during docking and launching of the craft. Pockets in the ridges contain wheels mounted on circumferential planes parallel to the ridges for rotation on axles seated in the pockets. The upper portions of the wheels protrude above the crests of the ridges and the axle end bearing portions cooperate with the seats in the pockets to list the circumferential planes toward the valley and approximately perpendicular to the hull sides. For optimal performance, two or more roller assemblies can be arranged in-line and spaced apart longitudinally in each of the ridges. A brake stops the docking motion of the watercraft onto the dock. Multiple docks can be serially connected without use of special tools or underwater assembly steps.

6 Claims, 10 Drawing Sheets

ROLLER ASSEMBLY FOR FLOATING DOCK

BACKGROUND OF THE INVENTION

This invention relates generally to floating docks for personal watercraft and more particularly concerns a roller assembly facilitating travel of the watercraft hull on the dock during docking and launching of the craft.

It is fairly common practice to incorporate a single concave roller in the stern end of the keel valley of a floating dock for personal watercraft. The roller is oriented with the expectation that the keel of the watercraft will contact the nadir of the concave surface of the roller during docking and launching of the craft. This orientation has some undesirable results. First, the majority of the weight of the watercraft on the dock may be borne by the single roller. Typically, the roller quickly wears out or is damaged or destroyed. Sometimes, however, the keel or hull will be damaged. Second, since the roller is concave, if the keel is not properly aligned with the roller during the docking approach, the hull rather than the keel strikes the roller and the roller does not perform in its intended fashion. Third, since the roller lifts the center of a properly aligned watercraft, the watercraft will list to one side of the dock or even wobble from side to side, depending on the water surface conditions or the distribution of weight on the watercraft. Fourth, with a single roller at the stern of the dock, when the center of gravity of the watercraft moves forward of the roller, the bow exerts the full weight of the watercraft downwardly onto the dock surface and impedes smooth movement of the watercraft onto or from the dock.

An additional problem associated with known floating docks is that the dock material is selected in part for a low coefficient of friction so that the watercraft hull might slide relatively easily on the dock surface. Consequently, the more effectively the dock fulfills the docking function, the more likely the bow of the watercraft is to overshoot its intended stopping point on the dock. This can result in unstable orientation of the watercraft on the dock or in damage to the hull or the dock at their points of impact.

Finally, floating docks are often serially laterally connected so as to accommodate more than one personal watercraft. Known connection systems inconveniently require the use of special tools and generally involve the awkward use of these tools underwater to accomplish the connection.

It is, therefore, an object of this invention to provide a roller assembly that receives the hull rather than the keel of the watercraft. Another object of this invention is to provide a roller assembly that protrudes above those ridges along the surface the dock that would otherwise support the hull on the dock. A further object of this invention is to provide a roller assembly that can be used as part of a spaced-apart parallel array of similar assemblies so as to apply the force exerted by the hull to more than one roller assembly. Yet another object of this invention is to provide a roller assembly that can be used in arrays on opposite side of the keel valley so as to support both sides of the hull of the watercraft. It is also an object of this invention to provide a roller assembly that can be used in arrays on opposite sides of the keel valley so as to distribute the weight of the watercraft against the dock to both sides of the hull. Still another object of this invention is to provide a roller assembly with a convex roller so that contact with the watercraft is made at the intended circumference of the roller. A further object of this invention is to provide a stop assembly to brake the sliding motion of a docking watercraft as it is fully received on the dock.

Another object of this invention is to provide a coupling suitable to easily serially laterally connect floating docks to each other. And it is an object of this invention to provide a coupling that does not require the underwater use of tools to connect floating docks to each other.

SUMMARY OF THE INVENTION

In accordance with the invention, a roller assembly is provided for facilitating travel of a watercraft hull on a floating dock. The dock has a longitudinal valley for receiving the keel of the watercraft and a pair of ridges flanking the valley for supporting opposite sides of the hull during docking and launching of the craft on and from the dock. The roller assembly includes a pocket disposed in one of the ridges. A wheel mounted in the pocket rotates about the mid-portion of an axle. The wheel is oriented in the ridge with its circumferential plane parallel to the direction of motion of the watercraft. The upper portion of the wheel protrudes above the crest of the ridge. The axle end bearing portions are co-operable with seats in the pockets to list the circumferential plane toward the valley. It is most desirable that the circumferential plane of the wheel be approximately perpendicular to the face of the hull that it will support. The extent of the protrusion of the wheels above the ridge and the degree of list can be adjusted by use of shims between the pocket seats and the axle end bearing portions. Greater protrusion results in less surface contact between the hull and the dock, making docking and launching easier. Perpendicularity of the wheel circumferential plane to the hull surface reduces stress on the assembly. Two or more such roller assemblies can be spaced apart longitudinally in one or both of the ridges, preferably in opposite relationship across the valley.

The watercraft hull and bow receiving surfaces of the floating dock should, as in known docks, have a coefficient of friction suitable to permit easy sliding of the watercraft onto the dock. In order to stop the travel of a docking watercraft once it is fully loaded onto the dock, a brake consisting of a seat and stop is provided at the bow portion of the dock. The seat is integrally formed in a portion of the bow-receiving surface of the dock. The stop has an upper surface contoured to receive a portion of the bow of the watercraft and a lower surface contoured to nestle in the seat. The upper surface of the stop has a coefficient of friction substantially greater than the coefficient of friction of the hull and bow receiving surfaces of the dock so as to more rapidly slow the sliding watercraft to a stop.

BRIEF DESCRIPTION OF THE DRAWINGS

Other objects and advantages of the invention will become apparent upon reading the following detailed description and upon reference to the drawings in which.

While the invention will be described in connection with preferred embodiments thereof, it will be understood that it is not intended to limit the invention to those embodiments or to the details of the construction or arrangement of parts illustrated in the accompanying drawings.

DETAILED DESCRIPTION

Figure 1:
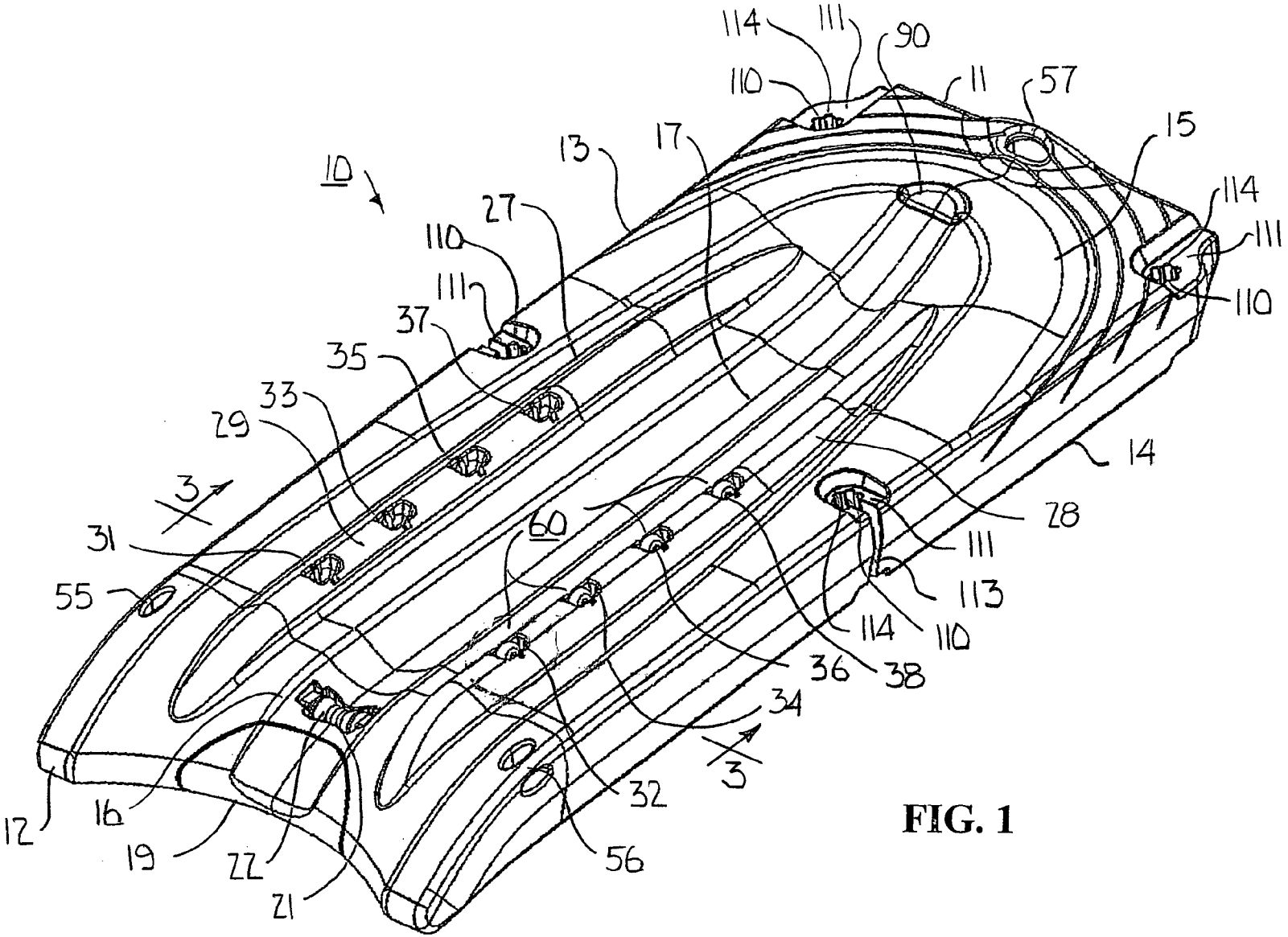
FIG. 1 is a top perspective view of a floating dock for a personal watercraft, the dock having two in-line arrays of roller assemblies for engagement with the sides of the watercraft hull.
Figure 2:
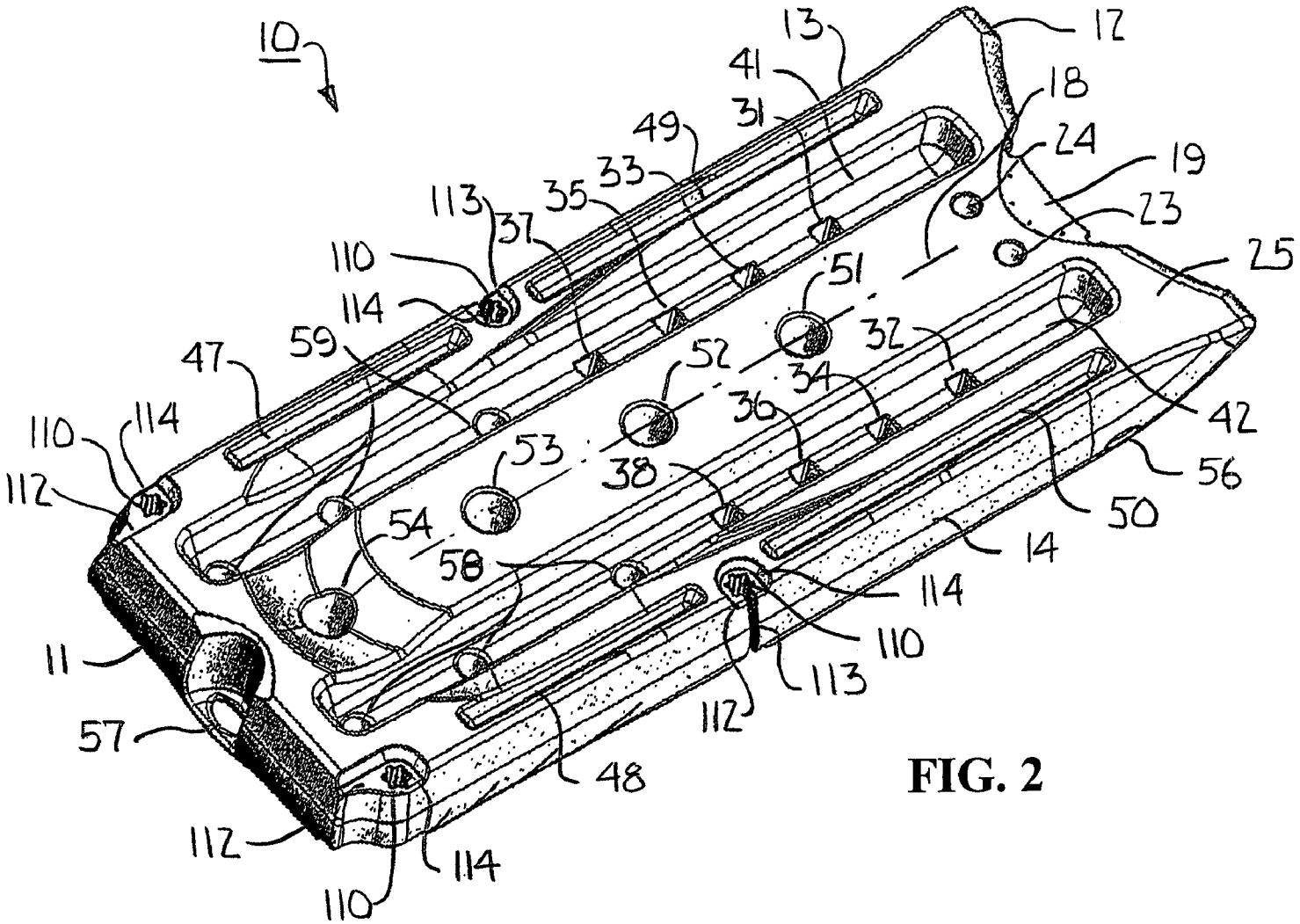
FIG. 2 is a bottom perspective view of the dock of FIG. 1.
Figure 3:
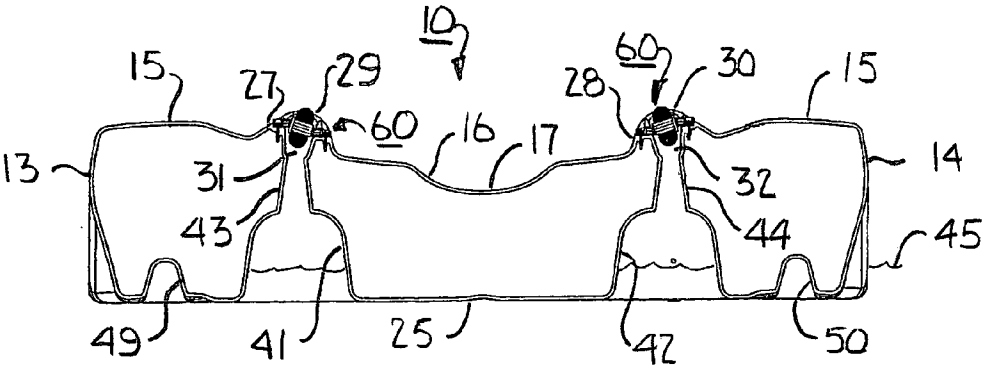
FIG. 3 is a cross-sectional view taken along the line 3-3 of FIG. 1.

Turning first to FIGS. 1, 2 and 3, a floating dock 10 is provided for a personal watercraft having a hull which angles upwardly on both sides of its keel at an angle of approximately 16 to 22 degrees above horizontal (not shown). As seen in FIG. 1, the dock 10 has bow and stern walls 11 and 12 and port and starboard sidewalls 13 and 14 defining its perimeter. The perimeter of the dock 10 is generally orthogonal but the stern wall 12 is indented to better receive the arcuate contour of the bow of the watercraft as it makes docking contact with the dock 10. The dock 10 has a top surface 15 contoured for several specific purposes. The stern portion of the top surface 15 tapers downwardly so as to facilitate the docking and launching operations of the watercraft onto and from the dock 10. The top surface 15 has a keel valley 16 with its nadir 17 aligned in a vertical plane through the longitudinal center axis 18 of the dock 10. The stern end of the keel valley 16 includes a removable strike plate 19 which is replaceable when worn or damaged. The bow end of the keel valley 16 has a bow stop 90, hereinafter further described. A central pocket 21 is provided in the stern portion of the dock top surface 15 immediately forward of the strike plate 19. A concave stern roller 22 seated in the central pocket 21 protrudes slightly above the top surface 15 of the dock 10 to facilitate sliding of the keel of the watercraft into and from the keel valley 16. Looking at FIG. 2, access holes 23 and 24 in the bottom surface 25 of the dock 10 facilitate mounting and removal of the stern roller 22 to and from the dock 10. Returning to FIG. 1, the top surface 15 of the dock 10 has ridges 27 and 28 which flank the keel valley 16. The crests 29 and 30 of the ridges 27 and 28 are spaced laterally from and elevated above the keel valley nadir 17 so as to support the hull of a typical watercraft when the keel of the watercraft is aligned and seated on the nadir 17 of the keel valley 16. As shown, the crests 29 and 30 are substantially parallel to the keel valley 16, but they need not necessarily be parallel as will hereinafter be explained.

As seen in FIGS. 1 and 3, the ridges 27 and 28 have a plurality of pockets, as shown four pockets 31, 33, 35 and 37 in the port side ridge 27 and four pockets 32, 34, 36 and 38 in the starboard side ridge 28. The stern-most pockets 31 and 32 are spaced forward of the central pocket 21 in the keel valley 16. The remaining pockets 33-38 are substantially equally internally spaced forwardly from the stern-most pockets 31 and 32 to approximately the midportion of the dock 10. In the illustration of FIG. 1, the port pockets 31, 33, 35 and 37 are empty and each of the starboard pockets 32, 34, 36 and 38 contains a roller assembly 60 hereinafter explained in greater detail. While it is preferred that four pockets be provided in each ridge 27 and 28 at substantially equally spaced apart longitudinal intervals and in laterally symmetrical arrangement in relation to the keel valley nadir 17, the number and spacing of pockets can be varied and asymmetrical, so long as at least one roller assembly 40 is located in each ridge 27 and 28. As seen in FIGS. 2 and 3, the bottom surface 25 of the dock 10 is provided with port and starboard elongated drain troughs 41 and 42 aligned with the port pockets 31, 33, 35 and 37 and starboard pockets 32, 34, 36 and 38, respectively. As best seen in FIG. 3, the troughs 41 and 42 are extended to each of their respective pockets, as shown the pockets 31 and 32, by reinforcing structure 43 and 44 so as to allow the pockets to drain to the water surface 45.

As best seen in FIGS. 2 and 3, the bottom surface 25 of the dock 10 also has port and starboard bow and stern grips 47 and 49 and 48 and 50, respectively, for carrying the dock 10. Also, several reinforcing structures 51, 52, 53 and 54, as shown aligned on the dock longitudinal center axis 18 extend upwardly to support the nadir 17 of the keel valley 16. As shown, the forward-most reinforcing structure 54 is also used to access the bow stop 90 seen in FIG. 1. The dock 10 is also contoured to provide tie-ons, as shown port and starboard stem tie-ons 55 and 56 and central bow tie-on 57, along the perimeter of the dock 10. Additional port and starboard side reinforcing structures 59 and 58 extend from the port and starboard drain troughs 41 and 42 to the top surface 15 of the dock 10.

Continuing to look at FIGS. 1 and 2, the dock 10 also has a plurality of sockets 110, as shown one through each of the port and starboard bow corners and one through each of the port and starboard perimeter mid-portions of the dock 10. The sockets 110 are hereinafter described in greater detail. Any number of sockets 110 might be employed, provided that the sockets 110 are symmetrically dispersed in relation to the longitudinal center axis 18 of the dock 10. As shown, the dock surfaces 15 and 25 have flat portions 111 and 112, respectively, surrounding each of the sockets 110 and the mid-dock sockets 110 have slots 113 which extend from the port and starboard sidewalls 13 and 14 of the dock 10 into their respective sockets 110.

The remaining contours of the dock 10 are shaped to provide an attractive, aesthetic appearance. Typically, the dock 10 is made of polyethylene plastic selected both for its strength and for the coefficient of friction of its watercraft receiving surfaces, so that the watercraft can easily slide onto and from the dock 10 during the docking and launching processes, respectively. There will inherently be a limited amount of flexibility in the reinforced polyethylene plastic surface so as to provide some "give" as will hereinafter be explained.

Figure 5:
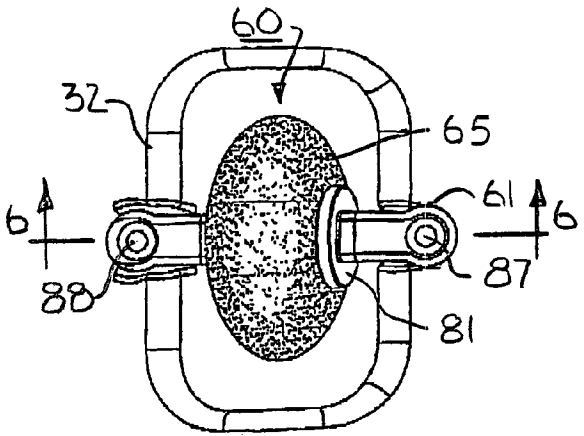
FIG. 5 is a top plan view of the roller assembly of FIG. 4.
Figure 6:
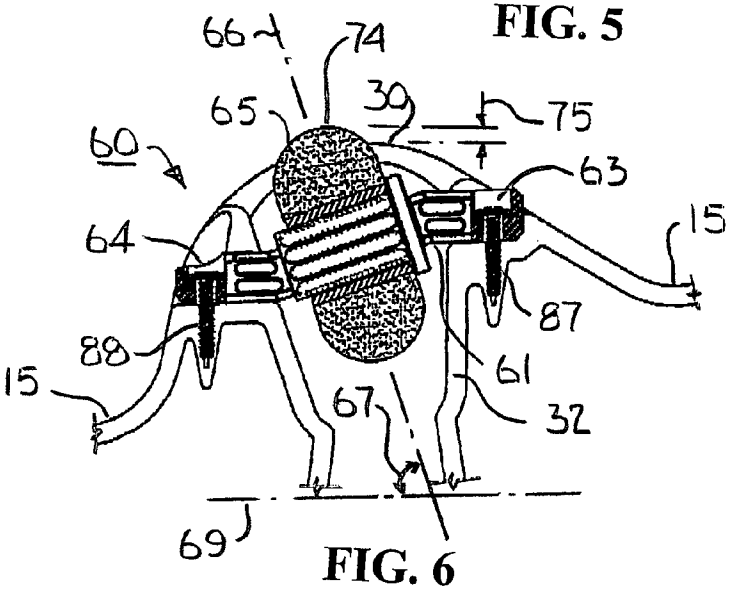
FIG. 6 is a cross-sectional view taken along the line 6-6 of FIG. 5.
Figure 4:
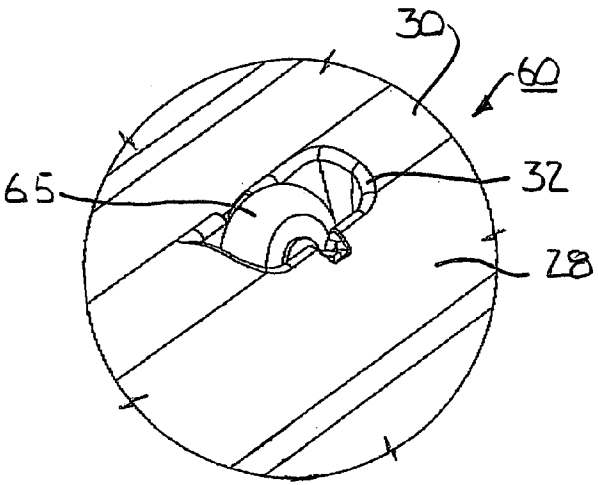
FIG. 4 is a top perspective view of one of the roller assemblies of FIG. 1.
Figure 7:
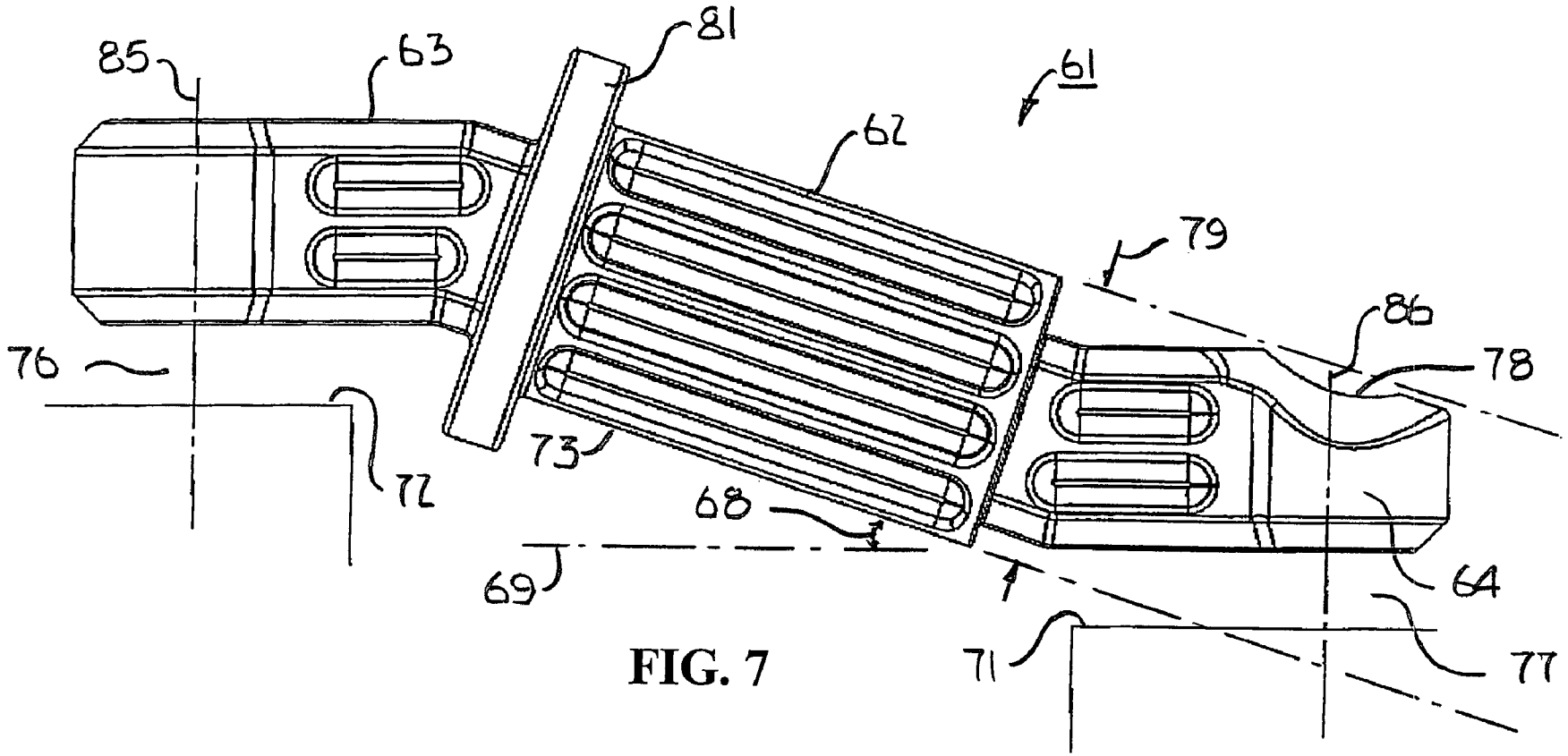
FIG. 7 is a front elevation view of the axle of the roller assembly of FIG. 4.

Turning now to FIGS. 4 through 9, the roller assemblies 60 are seen in greater detail. The roller assembly 60 is illustrated in FIGS. 4, 5 and 6 as mounted in the starboard stem-most pocket 32. However, as can be seen by reference to FIGS. 1 and 3, identical roller assemblies 60 can be mounted in any of the port or starboard pockets 31-38, the respective pockets 31, 33, 35 and 37 and 32, 34, 36 and 38 and roller assemblies 60 on the port and starboard ridges 27 and 28 being mirror images of each other. Each roller assembly 60 consists of an axle 61 having a midportion 62 and upper and lower end bearing portions 63 and 64, as is best seen in FIG. 7. Looking at FIG. 6, a wheel 65 mounted on the midportion 62 of the axle 61 is oriented so that the wheel circumferential plane 66 is at a list angle 67 inclined upwardly and toward the center longitudinal axis 18 of the dock 10. It is most preferable that this angle be such that the hull surface of the watercraft will be perpendicular to the list angle 67 of the wheel 65. As hereinbefore noted, most personal watercraft have hulls inclined at a slope approximating 16 to 22 degrees, a slope of 18 degrees being most common. Therefore, a list angle 67 of 72 degrees is preferred but any angle in a range of from approximately 65 to 75 degrees would function satisfactorily. Looking at FIG. 7, the slope angle 68 of the midportion 62 of the roller assembly axle 61 preferably complements the slope angle 67 of the wheel 65 relative to horizontal 69. Thus, for a wheel list angle of 72 degrees, an axle midportion slope angle 68 of 18 degrees is preferred.

As best seen in FIGS. 6 and 7, the roller assembly pocket 32 is provided with lower and upper seats 71 and 72 on which the end bearing portions 64 and 63 of the axle 61 are seated. The elevation of the seats 71 and 72 is selected so that, when the end bearing portions 64 and 63 of the axle 61 are properly seated on the horizontal seats 71 and 72, the slope angle 68 of the midportion 62 of the axle 61 will be at the appropriate angle above horizontal 69. The elevation of the seats 71 and 72 is also such that, when the roller assembly 60 is properly seated in the pocket 32, the upper portion 74 of the wheel 65 will protrude for a distance ranging from approximately 3/16 to 5/16 of an inch above the crest 30 of the ridge 28. A protrusion 75 of 3/16 inch without shims is preferred. A protrusion 75 of 3/16 inch will permit most personal watercraft to ride on the wheels 65 during the docking and launching processes and, when not in motion, due to the hereinbefore discussed "give" of the dock walls, as well as the slight flex of the hull of the watercraft and the slight compression of the wheels 65 of the roller assemblies 60, to rest on the ridges 27 and 28 of the dock 10. As can best be seen in FIG. 7, to compensate for these variables the seats 71 and 72 and their respective end bearing portions 64 and 63 can be adjusted by the use of shims in the spaces 76 and 77. The need for shims may be empirically determined for the particular watercraft to be used on the dock 10.

As can best be understood by reference to FIGS. 6 and 7, the lower end bearing portion 64 of the axle 61 is provided with a cut-out 78 so that it fits within the confines of the extended cylinder 79 defined by the midportion 62 of the axle 61. Thus, the wheel 65 can be mounted over the lower end bearing portion 64 onto the midportion 62 of the axle 61. A flange 81 on the upper end of the midportion 62 of the axle 61 prevents the wheel 65 from sliding upwardly off the midportion 62 of the axle 61. The diameter of the opening in the wheel 65 is slightly greater than the diameter of the midportion 62 of the axle 61 so that the wheel 65 is free to rotate on the axle 61. When the watercraft is not on the dock 10, the wheel 65 will naturally slip downwardly on the axle 61 as far as the pocket 32 will allow. As the watercraft hull makes contact with the wheel 65 and causes the wheel 65 to rotate on the axle 61, the force of the watercraft hull against the wheel 65 causes the wheel 65 to ride upwardly on the axle 61 until the hub of the wheel 65 contacts the flange 81.

Figure 8:
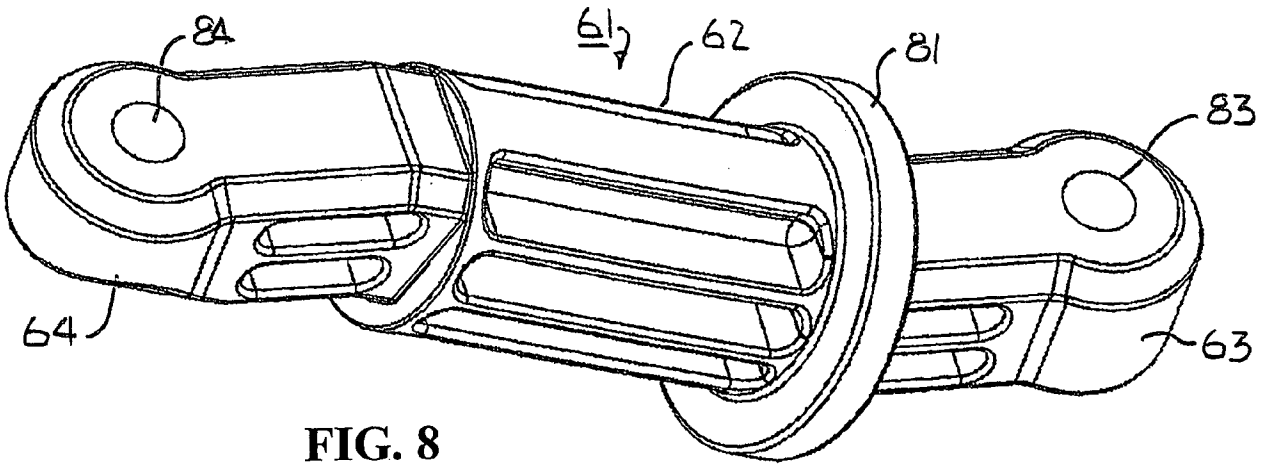
FIG. 8 is a bottom perspective view of the axle of FIG. 7.
Figure 9:
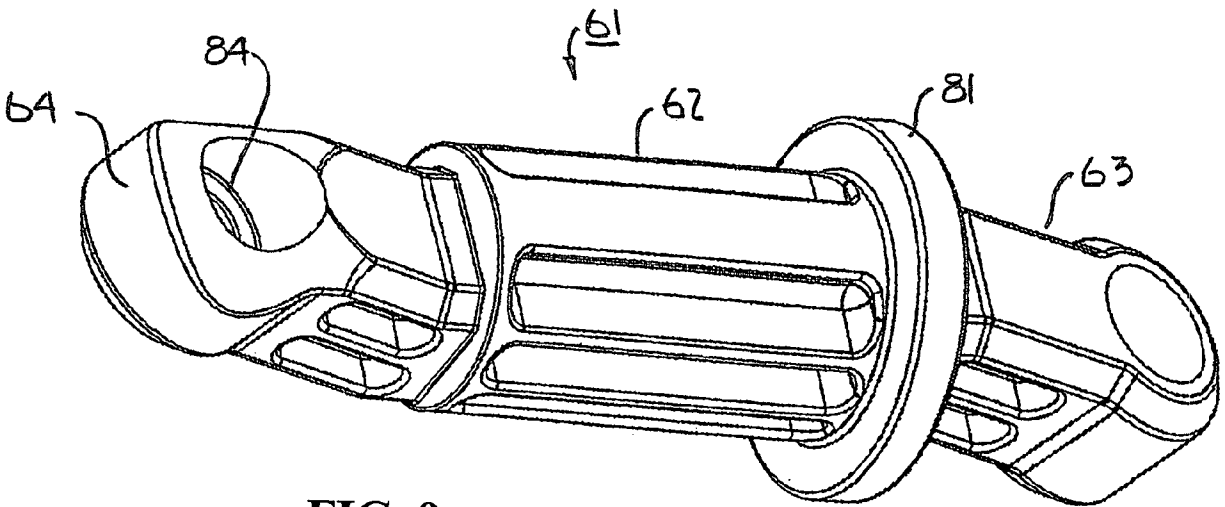
FIG. 9 is a top perspective view of the axle of FIG. 7.

Looking at FIGS. 7, 8 and 9, the upper and lower end bearing portions 63 and 64 of the axle 61 are provided with screw holes 83 and 84 on axes 85 and 86, respectively. Looking at FIGS. 5 and 6, the roller assembly 60 is secured in the pocket 32 by the use of screws 87 and 88 extending through the holes 85 and 86, respectively, and threaded into tap holes provided in the dock 10. The axles 61 may be formed from nylon. Wheels 65 having a diameter of 2.5 inches with a thickness of 1.125 inches and made of soft elastomer have been found to work effectively. However, axles 61 and wheels 65 of other materials and dimensions may be used.

While the dock 10 may be provided with a plurality of pockets in both of the ridges 27 and 28, roller assemblies 60 need not be used in all of the pockets. Rather, the most efficient arrangement of roller assemblies 60 will also be determined by empirical testing with the particular watercraft to be used with a given dock 10. It is presently anticipated that, if the symmetric, equally spaced pocket arrangement illustrated in FIG. 1 is used, most watercraft will be best efficiently served by use of roller assemblies 60 in the two stem-most pockets 31, 32, 33 and 34 of each ridge 26 and 28.

Figure 10:
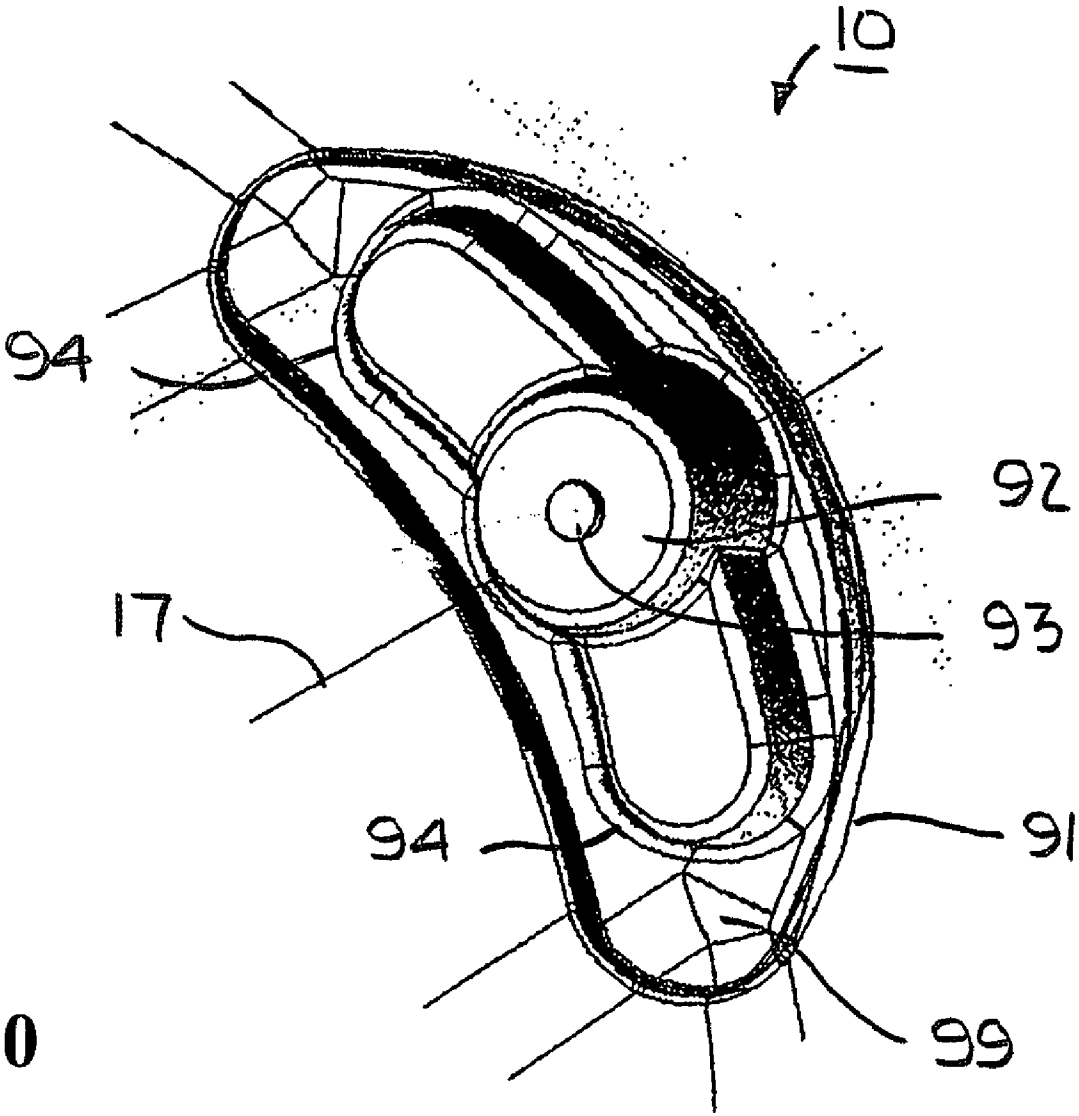
FIG. 10 is a top perspective view of the bow stop portion of the dock of FIG. 1.
Figure 11:
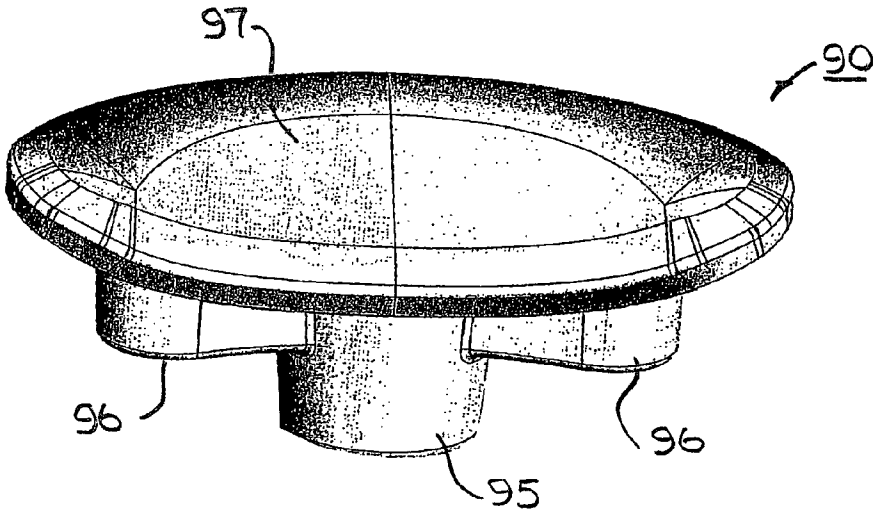
FIG. 11 is a rear perspective view of a bow stop for the dock of FIG. 1.
Figure 12:
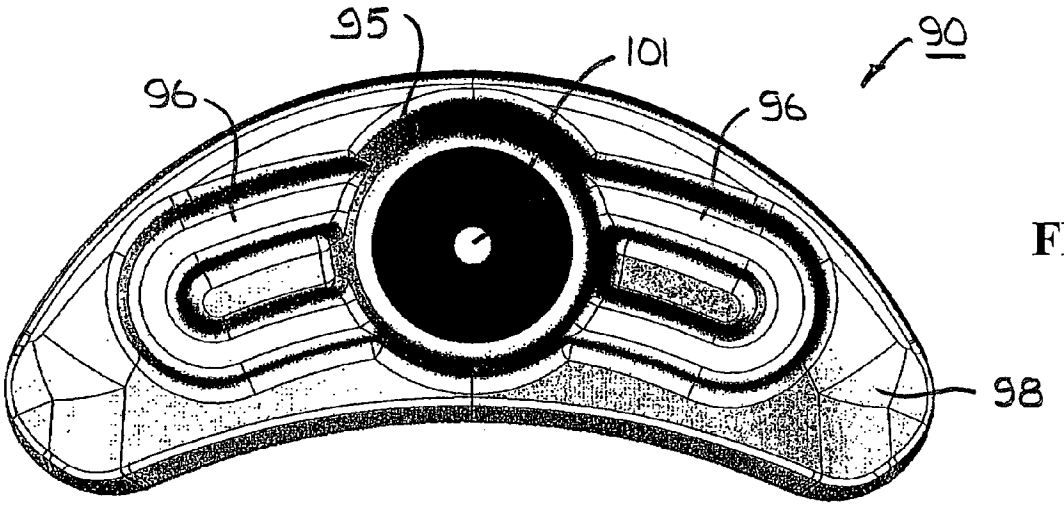
FIG. 12 is a bottom plan view of the bow stop of FIG. 11.
Figure 13:
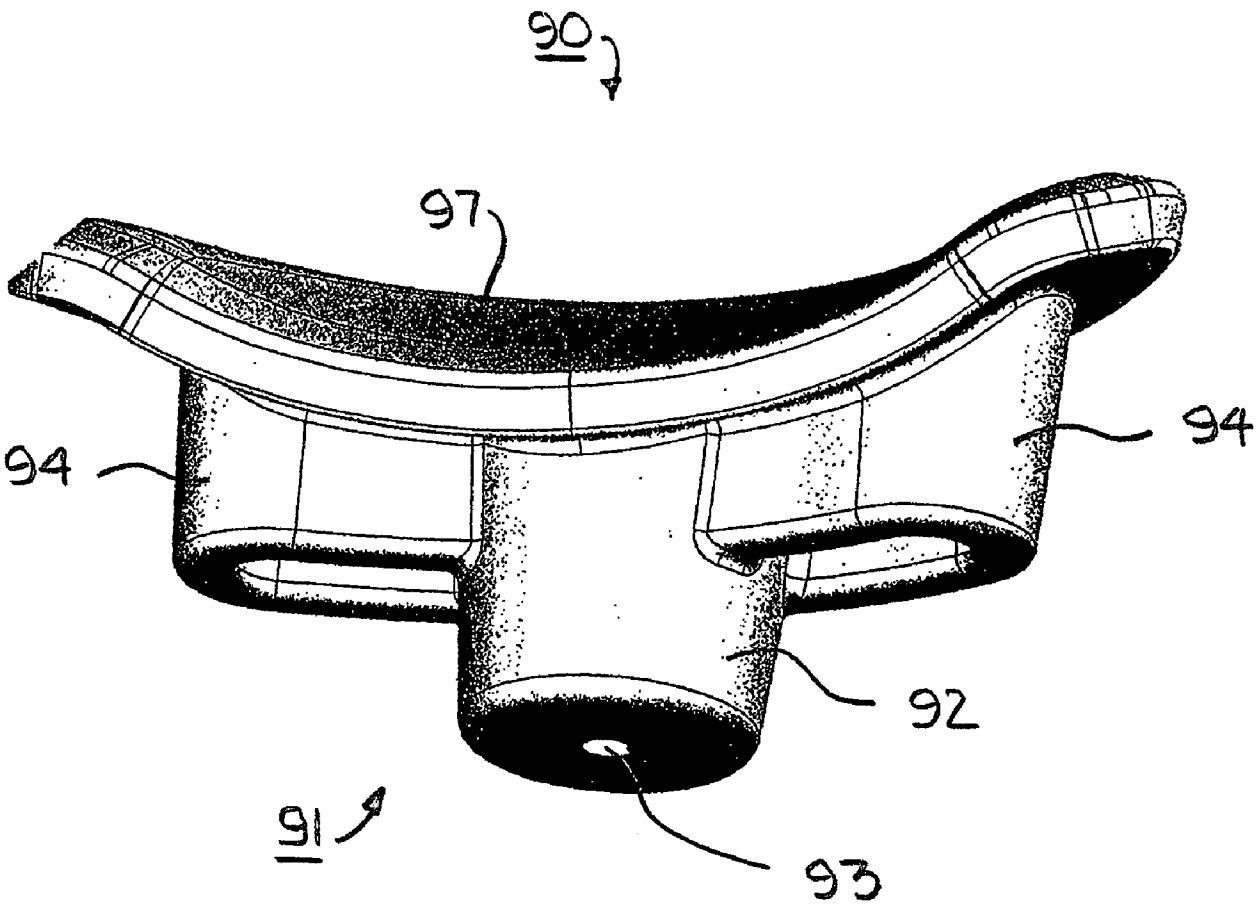
FIG. 13 is bottom perspective view of the bow stop of FIG. 11 seated in the receiver of the bow stop portion of the dock illustrated in FIG. 10.

Turning to FIGS. 10-13, the bow stop 90 and the manner of mounting the bow stop 90 on the dock 10 are illustrated. In FIG. 10, the portion of the top surface 15 of the floating dock 10 on which the bow stop 90 is to be mounted is shown. In the preferred embodiment shown, the dock top surface 15 has an integral seat 91 symmetrically aligned with respect to the plane of the keel valley nadir 17. A central frusto-conical receptical 92 with an axial bolt hole 93 is centered on the vertical plane extending through the keel valley nadir 17. Tapered wing receptacles 94 extend radially arcuately from the frusto-conical receptacle 92 within the seat 91. The bow stop 90 to be mounted in the seat 91 is best seen in FIGS. 11 and 12. The bow stop 90 includes a frusto-conical mounting cone 95 dimensioned to seat snugly within its mating receptacle 93 in the seat 91. Tapered reinforcing wings 96 extend arcuately radially outwardly from the cone 95 and are contoured to engage snugly against the tapered wing receptacles 94 of the seat 91. The upper surface 97 of the bow stop 90 sits integrally atop the frusto-conical cone 95 and reinforcing wings 96. The lower surface 98 of the bow stop is contoured to rest on the interior perimeter 99 of the seat 91, as is seen in FIG. 10. A threaded axial hole 101 is provided in the bottom of the frusto-conical cone 95. Looking at FIG. 13, the bow stop 90 is shown mounted in its integral seat 91. When the bow stop 90 is fully inserted into the seat 91 in the dock 10, the cone 95 is fully seated in the conical receptacle 92, the wings 96 are fully seated in the wing receptacles 94 and the bottom perimeter of the bow stop 90 rests against the interior perimeter 99 of the seat 91. The threaded bolt hole 101 of the bow stop aligns with the bolt hole 93 through the seat 91 so that the threaded engagement of a bolt (not shown) through the seat 91 and into the bow stop 90 pulls the outer surfaces of the lower portion of the bow stop 90 against the inner surfaces of the seat 91. Returning to FIG. 1, the upper surface 97 of the bow stop 90 is seen to be contoured to the bow end of the keel valley 16. The bow stop 90 is formed of a material having a coefficient of friction greater than the coefficient of friction of the top surface 15 of the dock 10 so as to function as a brake as the watercraft slides onto the bow stop 90 during the docking process. A polyurethane bow stop 90 is suitable for use with a polyethylene dock 10.

Turning now to FIGS. 14-17, floating docks 10 are seen serially laterally connected to each other and to a fixed dock 100 by linear link and triangular link connectors 120 and 140. Since the docks 10 have sockets 110 which are symmetrically oriented in relation to the keel valley nadirs 17, when the docks are laterally serially juxtaposed, corresponding opposite sockets 110 are adjacent to each other. Looking at FIG. 15, the linear link connectors 120 consist of upper and lower linear links 121 and 122, upper and lower plugs 123 and 124 and 125 and 126 and rigid bolts 127 and 128. Steel bolts of ½ inch by up to approximately 19 inches long have been found to have sufficient rigidity. As can best be seen in FIGS. 1 and 14, the linear links 121 and 122 are flat members shaped to be seated against the flat portions 111 and 112 provided at the upper and lower accesses to the sockets 110. Each of the links 121 and 122 have openings 129 proximate their ends with a plurality of grooves 131 in their perimeter. The grooved openings 129 are shaped and oriented to align with the grooves 114 in the sockets 110, seen in FIGS. 1, 2 and 14. Looking at FIG. 17, the length of the links 121 and 122 is such that, when the socket grooves 114 are aligned with the link grooves 131, the starboard side 14 and port side 13 of adjacent docks 10 are slightly separated from each other. The plugs 123, 124, 125 and 126 each have bodies 132 with splines 133 configured for snug insertion through the grooved openings 129 of the links 121 and 122 into engagement with the grooves 114 of the sockets 110. The walls of the sockets 110 and the splined bodies 132 taper toward the center of the sockets 110. Each of the plugs 123, 124, 125 and 126 has a wider diameter cap 134 which engages against the links 121 and 122 when the bodies 132 are fully inserted through the link openings 129. The upper plugs 123 and 124 have axial bolt holes 135 therethrough and the lower plugs 125 and 126 have axial threaded holes 136. When the bolts 127 and 128 are threaded into the lower plugs 125 and 126, the bolts heads 137 engage in recesses 138 in the caps 134 to clamp the links 121 and 122 between the upper and lower surfaces 15 and 25 of the dock 10 and the bolt caps 134. The bolts 127 and 128 are sufficiently long so that the space 139 between the upper and lower plugs 123 and 125 and 124 and 126 can be expanded to exceed the depth of the dock 10. Thus, the connector 120 can be preassembled with the plugs 123 and 125 and 124 and 126 at maximum spacing and the bolts 127 and 128 of the connectors 120 can be slid into the slots 113 of the sockets 110. The connectors 120 can then be tightened by turning the bolts 127 and 128 from above, eliminating the need for work or tooling below the water line.

Figure 16:
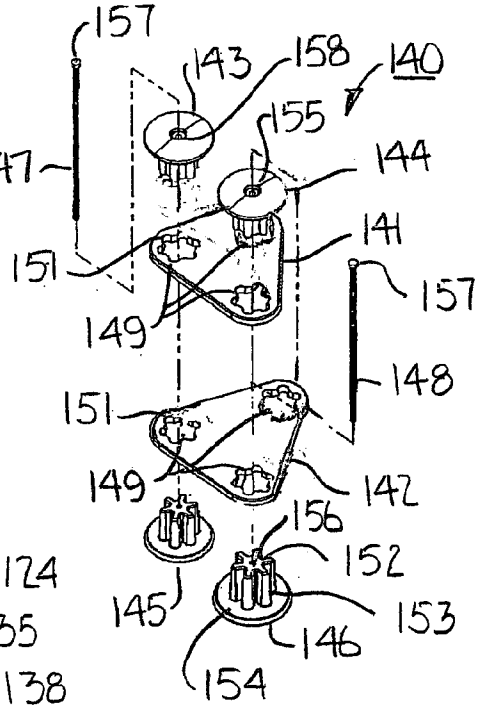
FIG. 16 is a top perspective assembly view of the fixed dock and watercraft triangular connector of FIG. 14.
Figure 15:
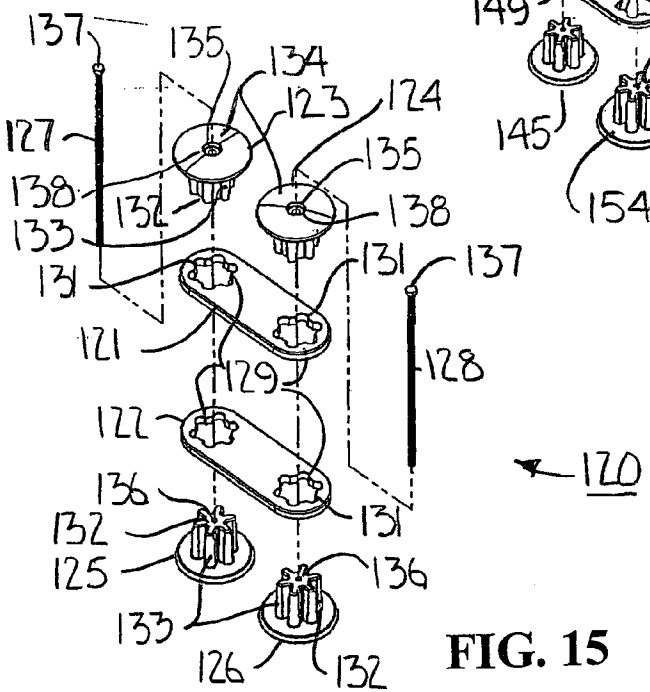
FIG. 15 is a top perspective assembly view of the mid-float and fixed dock linear link connectors of FIG. 14.

Looking at FIG. 16, the triangular link connectors 140 consist of upper and lower links 141 and 142, upper and lower plugs 143 and 144 and 145 and 146 and rigid bolts 147 and 148. As can best be seen in reference to FIGS. 1 and 14, the transducer links 141 and 142 are flat members shaped to be seated against the flat portions 111 and 112 provided at the upper and lower accesses to the sockets 110. Each of the links 141 and 142 have openings 149 proximate their corners with a plurality of grooves 151 in their perimeters. The grooved openings 149 are shaped and oriented to align with the grooves 114 in the sockets 100, as may be seen in FIGS. 1, 2 and 14. As with the linear links 121 and 122, the triangular links 141 and 142 are equilateral and the openings 149 are spaced so that, when the socket grooves 114 are aligned with the link grooves 151, the starboard side 14 and port side 13 of adjacent docks 10 are slightly separated from each other. The plugs 143, 144, 145 and 146 each have bodies 152 with splines 153 configured for snug insertion through the grooved openings 149 of the links 141 and 142 into the grooves 114 of the sockets 110. As with the linear links 121 and 122, the walls of the sockets 110 and the spline bodies 152 taper toward the center of the sockets 110. Each of the plugs 143, 144, 145 and 146 have wider diameter caps 154 which engage against the links 141 and 142 when the bodies 152 are fully inserted through the link openings 149. The upper plugs 143 and 144 have axial bolt holes 155 therethrough and the lower plugs 145 and 146 have axial threaded holes 156. As with the linear links 121 and 122, when the bolts 147 and 148 are threaded into the lower plugs 145 and 146, the bolt heads 157 engage in the recesses 158 in the caps 154 to clamp the links 145 and 142 between the upper and lower surfaces 15 and 25 of the dock 10 and the bolt caps 154. As with the bolts 127 and 128 seen in FIG. 17, the bolts 147 and 148 are sufficiently long so that the space between upper and lower plugs 143 and 145 and 144 and 146 can be expanded beyond the depth of the dock 10. Thus, the connector 140 can be preassembled with the plugs 143 and 145 and 144 and 146 at maximum spacing. Consequently, the bolts 147 and 148 of the connectors 140 can be slid into the slots 113 of the sockets 100. The connectors 140 can then be tightened by turning the bolts 147 and 148 from above, eliminating the need for work or tooling below the water line.

Returning to FIG. 14, the linear connectors 120 are used to interconnect the laterally adjacent docks 10 to each other or to connect the outer bow corners of the serially connected docks 10 to slide poles 161 mounted vertically on the side of a fixed dock 100. The latter connection is accomplished by using only one pair of plugs 123 and 125 or 124 and 126 and sliding the unplugged openings 129 of the links 121 and 122 over the slide poles 161. The spacing of the upper and lower linear links 121 and 122 on the guide poles 161 can be maintained by use of a sleeve 162 disposed on the slide pole 161 and between the upper and lower links 121 and 122. The triangular link connector 140 is used to simultaneously connect the floating docks 10 to each other and to the fixed dock 100. As shown, the unplugged openings 149 of the triangular links 141 and 142 are slidably engaged on the slide pole 161.

Figure 14:
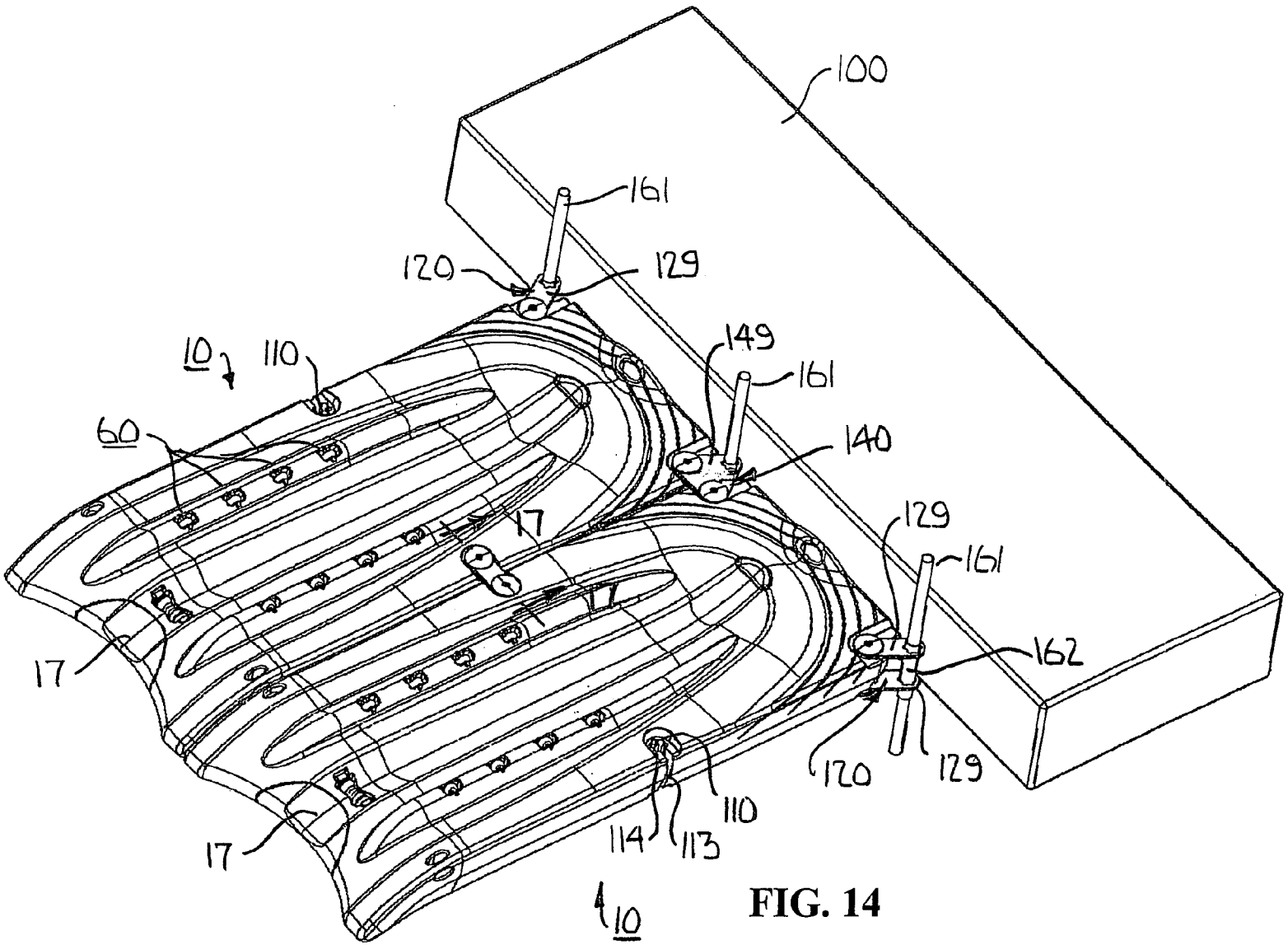
FIG. 14 is a top perspective view illustrating the serial connection of floating docks.
Figure 17:
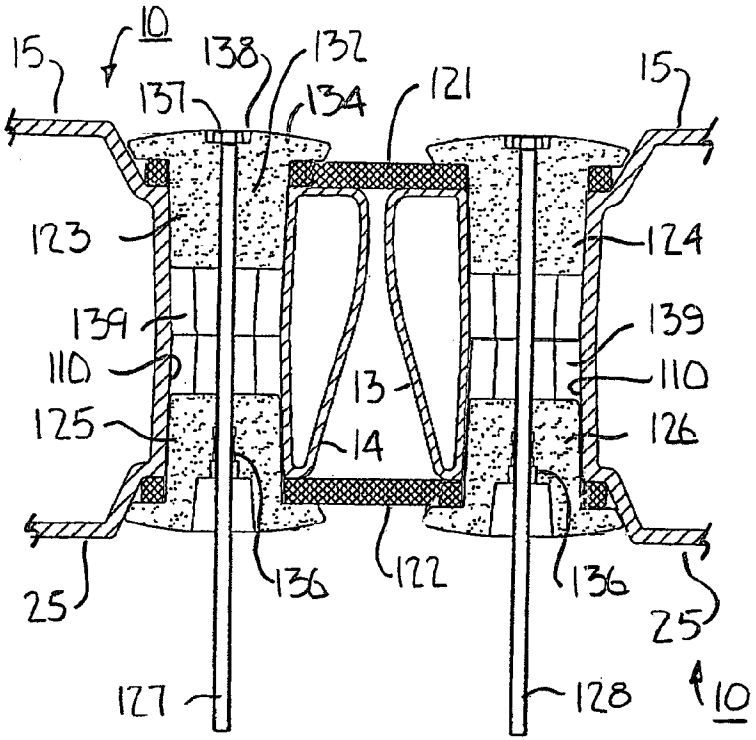
FIG. 17 is a cross-sectional view taken along the line 17-17 of FIG. 14.

Any number of floating docks 10 can be laterally serially connected in the same manner as illustrated in FIGS. 14-17 and each floating dock 10 can be fitted with roller assemblies 60 in a pattern suited to a particular personal watercraft to be docked on each of the docks 10. As shown in FIG. 14, roller assemblies 60 have been mounted in every one of the pockets. This is by way of illustration only and the number and location of roller assemblies 60 in the pockets of any of the docks 10 will be empirically determined to suit the docking and launching characteristics of the specific watercraft associated with that dock 10.

In the docking operation, the keel of the watercraft strikes the plate 19 at the stern 12 of the floating dock 10 and the bow of the watercraft moves forward onto the central stern roller 22. As the hull of the watercraft continues to advance, the hull rides on the ridges 27 and 28 and the sides of the hull sequentially come into contact with the roller assemblies 60 which protrude slightly above the crests 29 and 30 of the ridges 27 and 28. As the watercraft continues to move forward, the bow of the watercraft rides onto the bow stop 90 which decelerates the watercraft to a stop. As the hull comes to a stop, the downward force of the hull slightly compresses the rollers and the dock and hull surfaces slightly give as hereinbefore discussed so that the hull of the watercraft is seated on the ridges 27 and 28 of the floating dock.

In the launching operation, as the watercraft is pushed rearwardly from the dock 10, the downward force of the watercraft is somewhat diminished and the roller assemblies 60 facilitate the rearward motion of the watercraft from the dock 10. As the watercraft continues to move rearwardly on the floating dock 10, the center stern roller 22 facilitates movement of the watercraft keel as the weight of the launching watercraft extending beyond the stern roller 22 causes the bow of the watercraft to rotate slightly upwardly to facilitate complete release of the watercraft from the floating dock 11.

Thus, it is apparent that there has been provided, in accordance with the invention, a roller assembly for a floating dock that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. For stopping travel of a docking watercraft on a floating dock having watercraft hull and bow receiving surfaces with a coefficient of friction suitable to permit easy sliding of the watercraft onto the dock, a brake comprising a seat integrally formed in at least a portion of the bow receiving surface of the dock and a stop having an upper surface contoured to receive at least a portion of the bow of the watercraft and a lower surface contoured to nestle in said seat, said upper surface having a coefficient of friction substantially greater than the coefficient of friction of the hull and bow receiving surfaces of the dock.

2. An assembly according to claim 1 further comprising means for securing said stop in said seat.

3. For use in serially laterally connecting a floating dock having vertical sockets therethrough proximate lateral side walls thereof, the sockets being symmetrically arranged in relation to a longitudinal center axis of the dock, to another floating dock having identical sockets identically symmetrically arranged, an assembly comprising upper and lower links, each said link having openings, one proximate each end thereof, upper and lower plugs, each insertable into one of said openings of its respective one of said upper and lower links and its respective upper and lower socket to sandwich said links between upper and lower surfaces of the dock and a cap of their respective said plugs; and a rigid bolt insertable through said upper plug and said socket and threadably engagable in said lower plug for clamping said upper and lower links between said caps of respective said upper and lower plugs and the upper and lower surfaces, respectively, of the dock.

4. A dock according to claim 3, each of the sockets and each of said link openings having matching pluralities of vertical grooves in walls thereof, said link grooves and each said plug having vertical splines on outer walls thereof, said splines cooperatively engaging in said socket grooves to prevent rotation of said plugs in said sockets and in said link grooves to prevent rotation of said links on said plugs.

5. For use in serially laterally connecting a floating dock having vertical sockets therethrough proximate lateral side walls thereof, each of the sockets having a plurality of vertical grooves in an inner wall thereof, the openings being symmetrically arranged in relation to a longitudinal center axis of the dock, to another floating dock having identical sockets identically symmetrically arranged, an assembly comprising:

upper and lower plugs, each said plug having a body and a wider coaxial end cap, said body having vertical splines on outer walls thereof, said plugs being insertable into respective upper and lower accesses of the dock sockets with said grooves and splines cooperatively engaging to prevent rotation of said plugs in the dock sockets, each of said upper plugs having an axial hole therethrough and each of said lower plugs having an axial threaded hole therein;

upper and lower links, each said link having openings, one proximate each end thereof, for receiving said bodies of respective ones of said plugs therethrough, said link openings having vertical grooves in a side wall thereof, said link grooves and said splines cooperatively engaging to prevent rotation of said links on said plugs; and a rigid bolt insertable through said upper plug and said dock socket and engagable in said axial threaded hole of said lower plug for clamping said upper and lower links between said caps of respective said upper and lower plugs and upper and lower surfaces, respectively, of the dock.

6. For facilitating travel of a watercraft hull on a floating dock having a longitudinal valley for receiving a keel of the watercraft therein and a pair of ridges flanking the valley for supporting opposite sides of the hull thereon during docking and launching of the craft on and from the dock, an improvement comprising a pocket in one of the ridges and a wheel mounted in said pocket for rotation about a mid-portion of an axle with a circumferential plane of said wheel parallel to a path of travel of the watercraft on the dock, an upper portion of said wheel protruding above a crest of the ridge not more than 5/16", said axle having end bearing portions co-operable with seats in said pockets to list said circumferential plane toward the valley.

* * * * *